US005732611A

United States Patent [19]

Voyer et al.

[11] Patent Number: 5,732,611

[45] Date of Patent: Mar. 31, 1998

[54] SPOOL CARRIER FOR DELIVERING YARN UNDER TENSION

[75] Inventors: Gerald G. Voyer, Woonsocket; Rene A. Corneau, Cumberland, both of R.I.

[73] Assignee: Wardwell Braiding Machine Company, Central Falls, R.I.

[21] Appl. No.: 730,491

[22] Filed: Oct. 11, 1996

[51] Int. Cl.[6] ..... D04C 3/14

[52] U.S. Cl. ..... 87/56; 87/57

[58] Field of Search ..... 87/55, 56, 57

[56] References Cited

U.S. PATENT DOCUMENTS

| | | | |
|---|---|---|---|
| 1,135,702 | 4/1915 | Larson . | |
| 2,211,730 | 8/1940 | Olson . | |
| 2,895,371 | 7/1959 | Herzog . | |
| 2,933,971 | 4/1960 | Silver et al. | 87/56 |
| 3,686,997 | 8/1972 | Strangfeld | 87/57 |
| 4,719,838 | 1/1988 | DeYoung | 87/57 |
| 4,788,898 | 12/1988 | Bull | 87/55 |
| 4,827,707 | 5/1989 | Zoulek | 87/57 |
| 4,903,574 | 2/1990 | Brown et al. | 87/57 |
| 5,370,031 | 12/1994 | Koyman et al. | 87/55 |
| 5,383,387 | 1/1995 | Chesterfield et al. | 87/56 |

*Primary Examiner*—William Stryjewski
*Attorney, Agent, or Firm*—Salter & Michaelson

[57] ABSTRACT

A spool carrier capable of delivering yarn under tension from a spool to a braiding machine includes a frame having a base, a center rod mounted on the base in a position that it extends upwardly therefrom along a vertical axis, and a support which axially retains the spool in place. The spool carrier further includes a tensioning mechanism for providing tension on the yarn of the spool. The tensioning mechanism releases yarn from the spool upon reaching a predetermined amount of tension on the yarn. The tensioning mechanism includes a power spring mounted on the base and engagable with the spool for providing a resisting tension being applied to the yarn and spool when reeling yarn off the spool, and a yarn releasing mechanism for enabling the rotation of the spool and for releasing yarn off the spool when the tension on the yarn exceeds a predetermined tension of the power spring.

10 Claims, 8 Drawing Sheets

SPOOL CARRIER FOR DELIVERING YARN UNDER TENSION

BACKGROUND AND SUMMARY OF THE INVENTION

This invention relates generally to a spool carrier for delivering yarn off a spool to a braiding machine, and more particularly to a spool carrier that can be easily manipulated to adjust the tension at which yarn is released from the spool.

Spool carriers for braiding machines, and other similar weaving and knitting equipment, are well-known in the art. Reference can be made to any of the U.S. Pat. No. 1,135,702 to Larson, U.S. Pat. No. 2,211,730 to Olson, U.S. Pat. No. 2,895,371 to Herzog, U.S. Pat. No. 2,933,971 to Silver et al., U.S. Pat. No. 3,045,526 to Harris, U.S. Pat. No. 3,686,997 to Strangfeld, U.S. Pat. No. 4,788,898 to Bull, U.S. Pat. No. 4,827,707 to Zoulek, and U.S. Pat. No. 4,903,574 to Brown et al. as representative prior art.

Of these patents, the spool carrier disclosed in the Harris patent is particularly representative of the industry standard. As shown therein, the spool carrier includes a base and a center rod extending vertically from the base upon which a spool having yarn may be rotatably received. The base has a hub with a pivot pin upon which a latch is mounted, the latch having an end that is engagable with teeth formed on the spool, and an opposite end engagable with a latch lift. Two standard members extend up from the base for receiving a tension weight that slides vertically on the standard members. Guides are provided for threading yarn from the spool so that it lifts the tension weight against the bias of a spring. The arrangement is such that when tension on the yarn exceeds the force of the spring, the tension weight is raised until it actuates the latch thereby disengaging the end of the latch from the teeth of the spool. This movement releases or reels off yarn from the spool.

One disadvantage associated with the Harris spool carrier is that in order to adjust the tension upon which carrier reels off yarn from the spool, the carrier needs to be disassembled for changing the spring. This also requires having on hand multiple springs, each with a different spring force. Another disadvantage is that with the type of spring provided in Harris (i.e., a helical spring), the spring force provided by the spring changes as the spring becomes compressed. Stated another way, the spring force applied by the spring to the tension weight does not remain constant, but increases and decreases as the spring becomes compressed and decompressed, respectively.

There is presently a need for a spool carrier that can easily be adjusted for changing the tension force required to release yarn from the spool and for a carrier that provides a consistent amount of tension on the yarn.

The present invention is directed to an improved spool carrier capable of delivering yarn under tension from a spool to a braiding machine. The spool carrier comprises a frame having a base, a center rod mounted on the base in a position that it extends upwardly therefrom along a vertical axis, and a support having means for retaining the spool axially in place. The spool carrier further comprises tensioning means for providing tension on the yarn of the spool. The tensioning means is adapted to release yarn from the spool upon reaching a predetermined amount of tension on the yarn. The tensioning means comprises adjustable spring means mounted on the base and engagable with the spool for providing a resisting tension on the yarn and spool when reeling yarn off the spool, and yarn releasing means for enabling the rotation of the spool and for releasing yarn off the spool when the tension on the yarn exceeds a predetermined tension of the spring means.

More specifically, the adjustable spring means comprises a coil spring disposed within an annular spring cage wherein the spring and spring cage are received over the center rod of the frame. The adjustable spring means further comprises a spring cup that receives the spring and spring cage therein, the spring cup engaging the spring cage for enabling rotation of the spring and spring cage when rotating the spring cup, wherein the spring force upon the spool as applied by the spring can be adjusted upon rotating the spring cup.

The yarn releasing means comprises a braider stop having a body portion that rides up and down on a support rod of the frame and an eye formed on the body portion for receiving yarn from the spool therethrough. The yarn, upon increasing tension thereon, is adapted to raise the braider stop, and upon decreasing tension thereon, is adapted to lower the braider stop. A cam reel is mounted on the spring and is rotatable about the center rod with the spring cage. The cam reel has a circumferential surface that defines a cam. A pawl, mounted on the base of the frame, rides on the cam. The pawl has an end that is engagable with teeth of a ratchet which is connected to the spool for rotation with the spool. The cam has a first portion that positions the pawl between two teeth of the ratchet for preventing the rotation of the spool and a second portion that moves the pawl away from the teeth for enabling the free rotation of the spool. The cam reel is attached to the braider stop by a cable wherein as tension on the yarn increases, the braider stop moves upwardly on the support rod thereby rotating the cam reel against the bias of the spring, and upon reaching a predetermined tension, the cam reel rotates so that the pawl rides on the first portion of the cam to the second portion thereof for disengaging the pawl from the teeth and thus enabling yarn to reel off the spool.

Accordingly, among the several objects of the present invention are the provision of an improved spool carrier that can easily be adjusted by hand for changing the tension force required to release yarn from the spool; the provision of such a spool carrier that maintains a constant tension force on the yarn; the provision of such a spool carrier that is more economical to produce than prior art spool carriers; the provision of such a spool carrier that can be easily assembled and disassembled; and the provision of such a spool carrier that is simple in design and construction, and durable during use.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
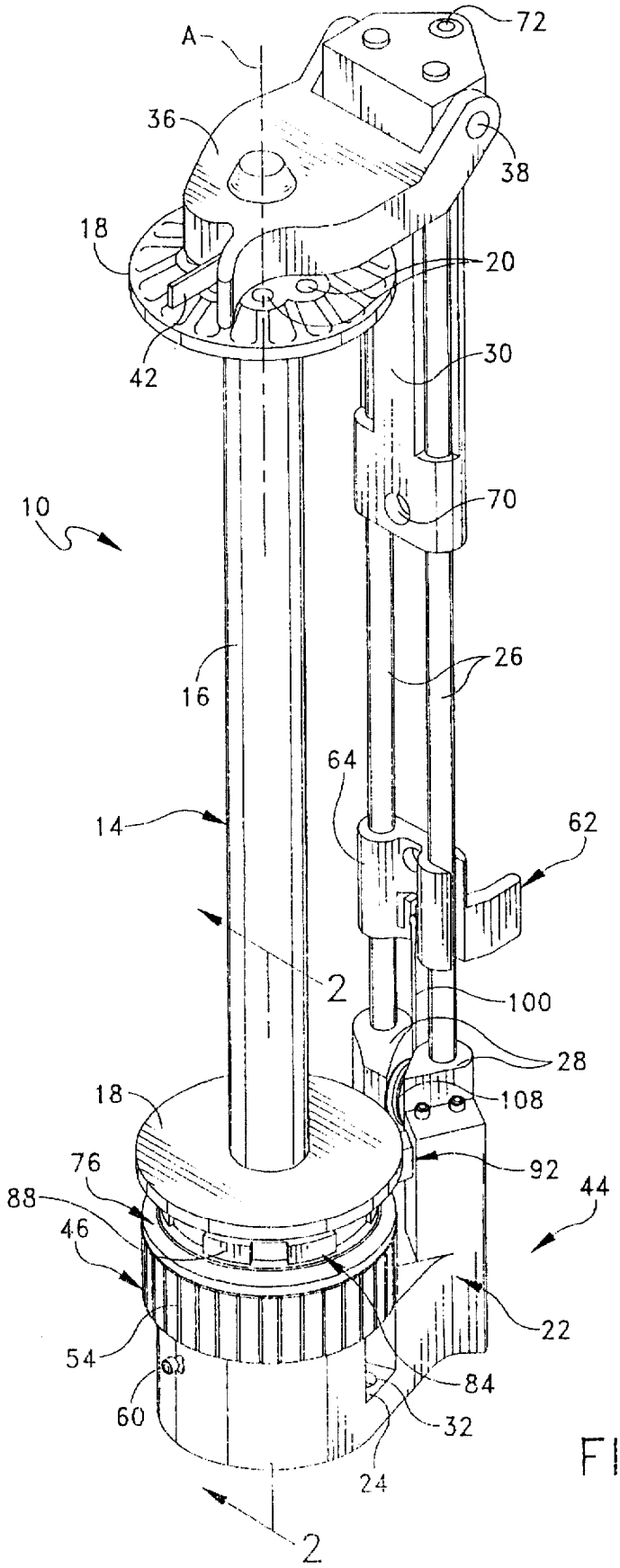
FIG. 1 is a perspective view of a spool carrier of the present invention.
Figure 2:
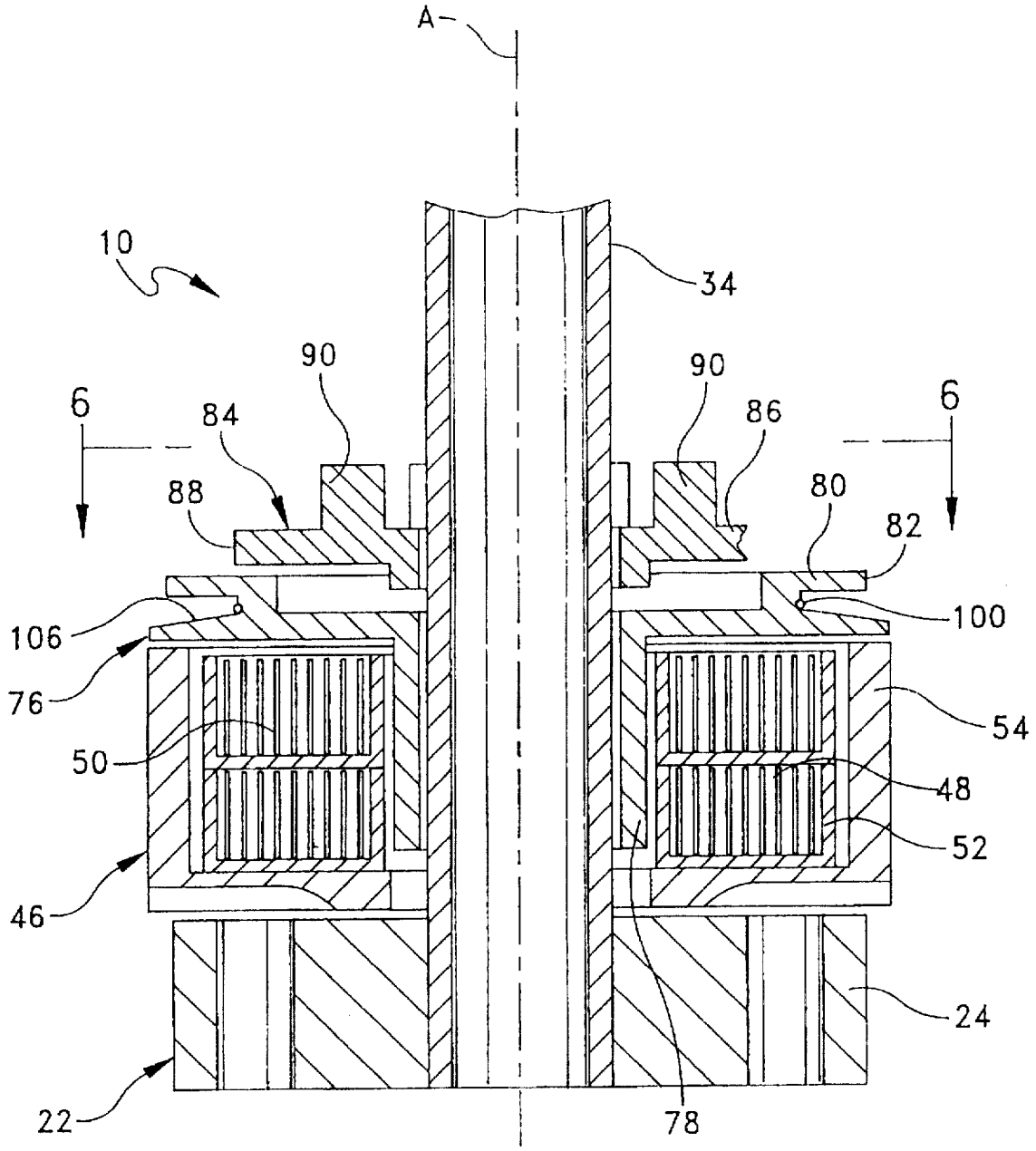
FIG. 2 is a cross-sectional view taken along line 2—2 of FIG. 1
Figure 3:
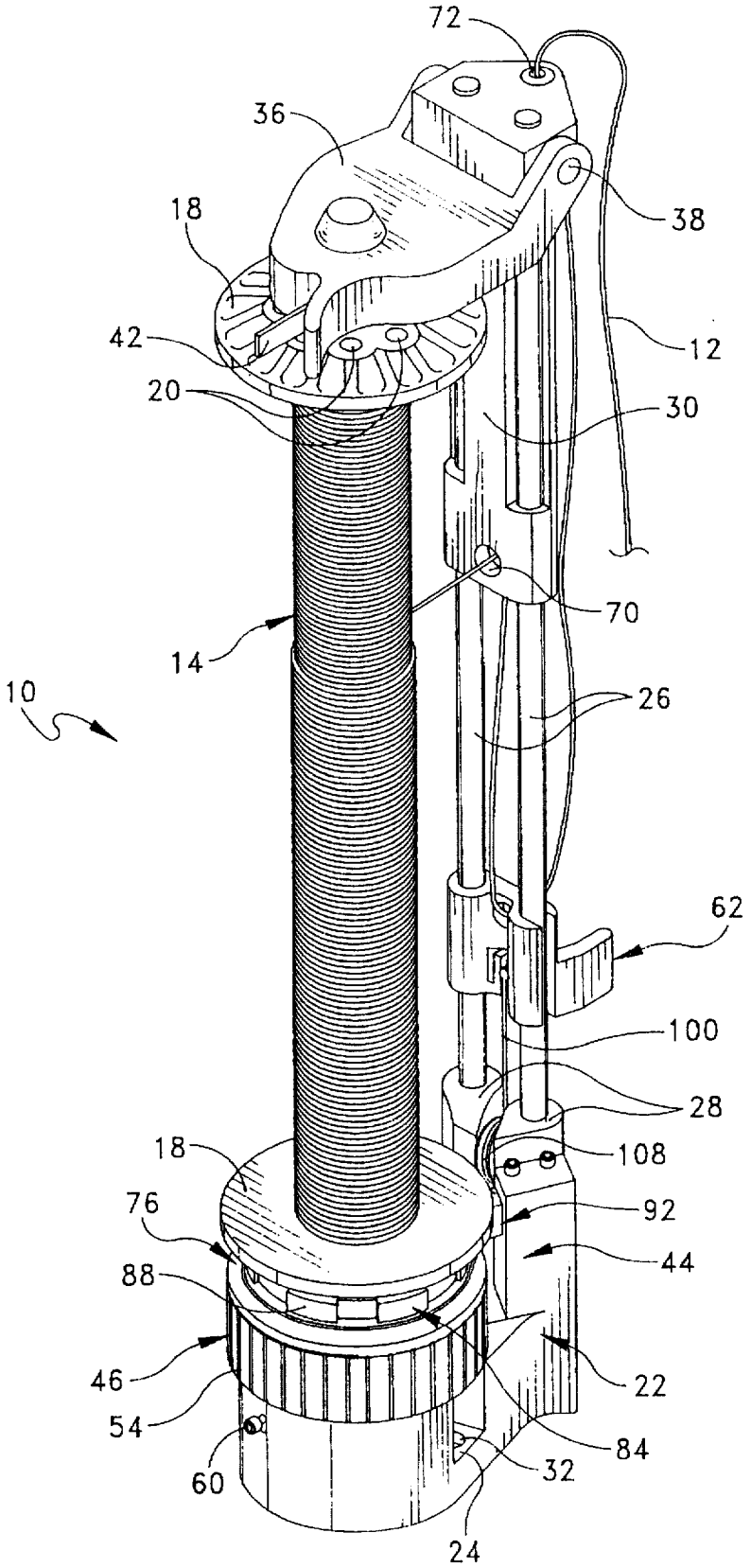
FIG. 3 is a perspective view similar to FIG. 1 illustrating the spool carrier with a spool mounted thereon in a locked position.

Referring now to the drawings, and more particularly to FIGS. 1–3, there is generally indicated at 10 a spool carrier of the present invention. The spool carrier 10 is especially suited for delivering yarn 12 (FIG. 3) under tension from a spool, generally indicated at 14, to a braiding machine (not shown), such as a maypole-type braiding machine that is well-known in the art of braiding machines.

Figure 4:
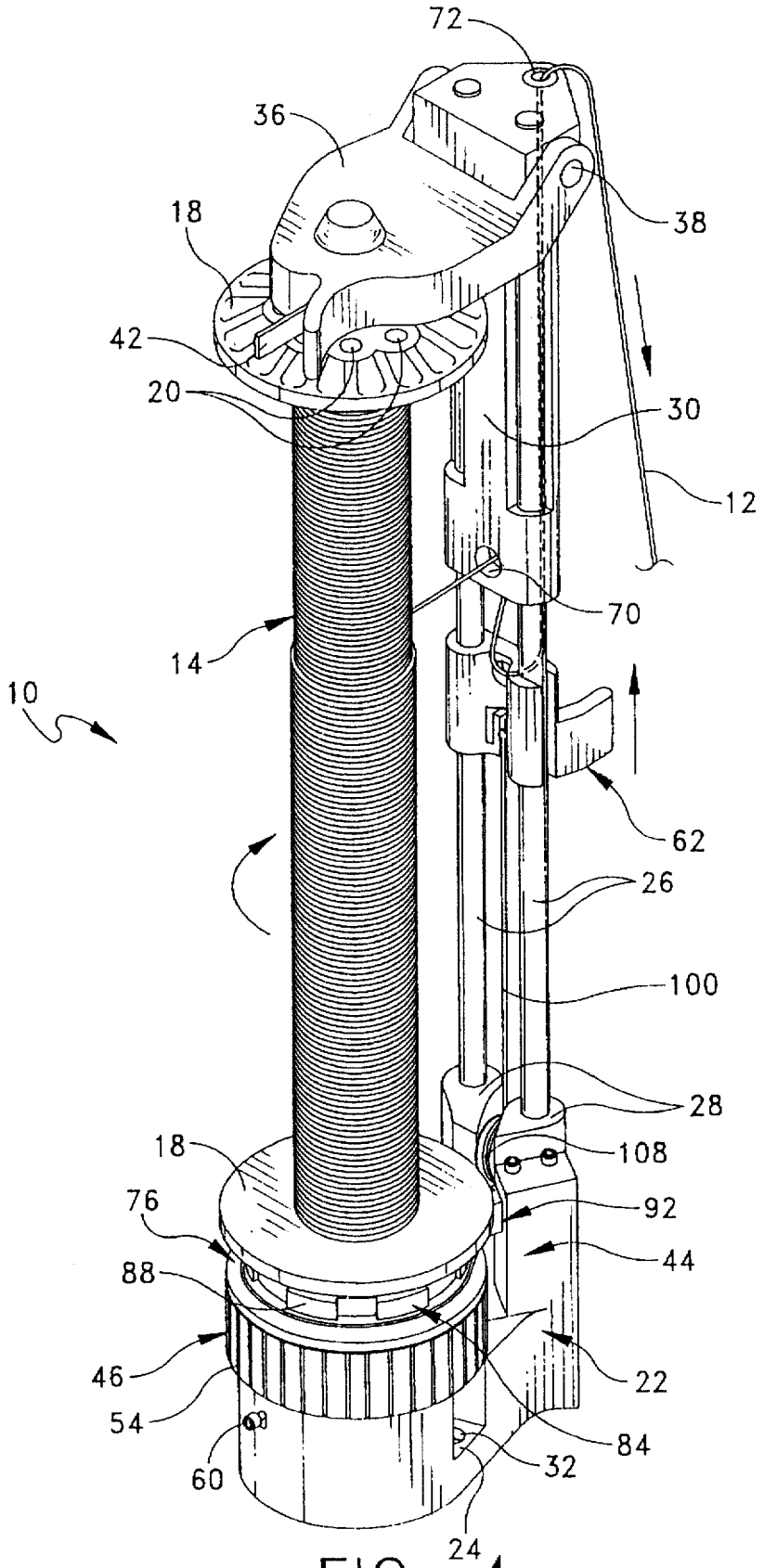
FIG. 4 is a perspective view similar to FIGS. 1 and 3 illustrating the spool freely rotating position for delivering yarn to a braider machine (not shown), for example.
Figure 5:
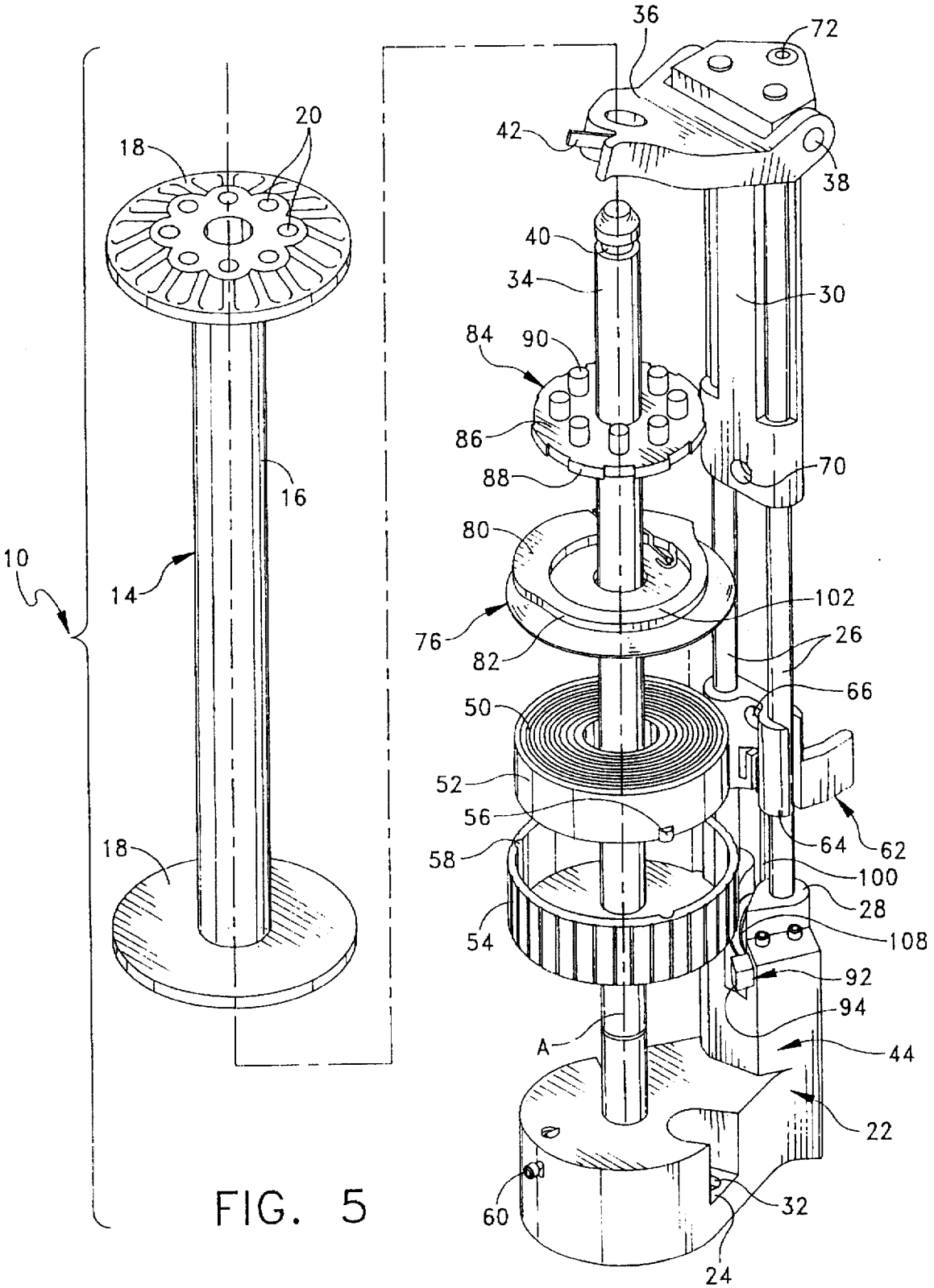
FIG. 5 is an exploded perspective view of the component parts of the spool carrier.

It should be understood that the spool carrier of the present invention can be used for any type of braiding, weaving, or knitting machine, and still fall within the scope of the present invention. As illustrated in FIGS. 1 and 5, the spool 14 is of typical construction, having an elongate cylinder or spindle 16 with a pair of flanges each indicated at 18 at opposite ends of the cylinder 16. Yarn 12 is spooled onto the spool 14 in the conventional manner (see FIGS. 3 and 4). Each flange 18 has a scalloped outer surface with a plurality of inwardly-formed bores 20 that are arranged in a circular pattern about the open end of the cylinder 16, the purpose of which will be described in greater detail below.

The spool carrier 10 comprises a frame, generally indicated at 22, the frame having a base 24, a pair of parallel support rods 26 that extend upwardly from a pair of bosses 28 formed in the base, and an upper support 30 fixedly mounted on the upper ends of the support rods. As shown in FIG. 2, the base 24 of the frame 22 has a pair of clearance openings 32 formed therein for bolting the spool carrier 10 on a suitable surface. The base 24 can be configured in any suitable manner for attachment to the surface. The frame 22 further includes a center rod 34 (FIG. 5) that is fixedly mounted on the base 24 and extends upwardly therefrom along a vertical axis A. The center rod 34 has a diameter smaller than the inner diameter of the cylinder 16 of the spool 14 so that the spool slides easily over the center rod and freely rotates about the rod.

The upper support 30 has a generally U-shaped spool lock 36 pivotally mounted thereon by a pair of pins 38 for locking the spool 14 in place after it is received over the center rod 34. As shown in FIG. 5, the upper end of the center rod 34 has a circumferential groove 40 formed therein that receives a locking member (not shown) of the spool lock 36 for preventing the axial movement of the spool 14 once it is received over the center rod 34. A latch 42 is provided for releasing the spool lock 36 from the center rod 34 when it is desired to remove the spool 14 from the spool carrier 10. More particularly, the latch 42 is biased toward the groove 40 of the center rod 34 and is positioned therein for locking the spool lock 36 to the rod 34. By moving the latch 42 away from the groove 40, the spool lock 36 is released from the center rod 34.

Generally indicated at 44 is tensioning means of the present invention for providing tension on the yarn 12 of the spool 14 that is fed to the braiding machine. The tensioning means 44 is designed to release yarn 12 from the spool 14 upon reaching a predetermined amount of tension on the yarn as applied by the braiding machine. Thus, before reaching a predetermined tension, the tensioning means 44 locks the spool 14 in place to prevent its rotation and the reeling off of yarn 12 from the spool 14. Upon reaching the predetermined tension, the tensioning means 44 releases the spool 14 so that it can freely rotate for releasing yarn 12 from the spool. It should be observed that the tensioning means 44 of the present invention is capable of being easily adjusted by hand for increasing or decreasing the tension at which yarn 12 is released from the spool 14 without having to disassemble the spool carrier 10.

Broadly speaking, the tensioning means 44 of the present invention comprises an adjustable spring assembly, generally indicated at 46, which operates in cooperation with a yarn releasing mechanism. The adjustable spring assembly 46 includes a power spring 48, such as the type sold by Ametek, of 900 Clymer Ave., Sellersville, Pa. which is sold under the registered trademark SPIR'ATOR®. The power spring 48 includes a long coil 50 that is wound within and fixedly attached to an annular spring cage 52 at one end thereof. The other end of the long coil 50 is fixedly attached to the article upon which spring loading is required. The power spring 48 is contained within a spring cup 54 in the manner shown in FIGS. 2 and 5. More specifically, the spring cage 52 has three outwardly extending detents 56 (FIG. 5) that are received within vertically oriented channels 58 formed on the inner surface of the spring cup 54. This configuration prevents the relative rotation of the power spring 48 with respect to the spring cup 54. As shown, the power spring 48 and spring cup 54 are received over the center rod 34 so that they are generally adjacent the base 24 of the frame 22. Also, it should be noted that the spring cup 54 enables rotation of the power spring 48 when rotating the spring cup, wherein the tension of the coil 50 of the power spring can be adjusted (i.e., the tension or spring bias of the power spring can be increased or decreased). The arrangement is such that by rotating the spring cup 54 in a clockwise direction, tension in the coil 50 is increased. A push button 60, which operates a spring mechanism (not shown) selectively engagable with the spring cup 54, is provided on the base 24 of the frame 22 for disengaging the spring cup 54 thereby allowing the spring cup to freely rotate and release the tension on the coil 50. By moving the button 60 downwardly, tension in the power spring 48 is released.

The yarn releasing mechanism of the present invention includes many components that interact with one another and the spring assembly 46 to release yarn 12 from the spool 14 when the tension of the yarn reaches a predetermined tension. As shown in FIG. 5, the yarn releasing mechanism comprises a braider stop, generally indicated at 62, having a body portion 64 with a pair of axially aligned bores (not designated) that receive the support rods 26 of the frame 22 therethrough. The braider stop 62 also includes an eye 66 (FIG. 5) formed in the body portion 64 of the braider stop 62, the eye 66 receiving the free end of the yarn 12 which is fed to the braiding machine. The braider stop 62 is designed to ride up and down on the support rods 26 as tension in the yarn 12 caused by the braiding machine increases and decreases, respectively. As illustrated in FIGS. 3 and 4, when the tension of the yarn 12 decreases, the braider stop 62 lowers (FIG. 3), and when the tension of the yarn increases, the braider stop rises (FIG. 4). As shown, yarn 12 is fed through an aperture 70 formed in the upper support 30 of the frame 22, through the eye 66, and up through another aperture 72 formed in the upper portion of the support 30. It should be noted that the free end of the yarn 12 is drawn by the braiding machine in the well-known manner (e.g., via a tensioning assembly (not shown).

The yarn releasing mechanism further includes a disc-shaped cam reel, generally indicated at 76, which is mounted on the inner end of the coil 50 of the power spring 48 by any suitable means for ensuring that the coil rotates upon rotation of the cam reel. The cam reel 76 has a centrally located opening formed by a cylindrical portion 78 for receiving the center rod 34 therethrough (see FIG. 2). As shown in FIG. 2, the cylindrical portion 78 is disposed within the power spring 48. An upper, annularly-shaped body portion 80 of the cam reel 76 has an outer circumferential edge 82 that defines a cam surface, the purpose of which will become apparent as the description of the yarn releasing mechanism proceeds. The arrangement is such that the power spring 48 is inserted into the spring cup 54 and the cam reel 76 is mounted thereon so that it is fixedly attached to the inner end of the coil 50 for creating an enclosed unit.

A ratchet, generally indicated at 84, is disposed over the spring cup 54, power spring 48 and cam reel 76 after these components are assembled and slid over the center rod 34. The ratchet 84 has an annular disc 86 which is received over the center rod 34 and disposed above the cam reel 76 (see FIG. 2). A plurality of teeth 88 are formed on the outer edge of the disc 86. The upwardly facing surface of the disc includes a number of upwardly projecting pins 90 corresponding with the number of bores 20 provided in the flange 18 of the spool 14 (e.g., eight), the pins 90 being arranged so that they are in registry with and are received within the bores 20 formed in one of the flanges 18 of the spool 14. The arrangement is such that upon rotation of the ratchet 84, the spool 14 rotates accordingly. It should be noted that the type of assembly depicted in the drawings and described herein is but one way of achieving the rotation of the spool 14, and that any other suitable mechanism is within the scope of the present invention.

The yarn releasing mechanism further includes a pawl, generally indicated at 92, with one of its ends suitably attached to the base 24 of the frame 22 so that it pivots along a plane perpendicular with respect to the axis A of the center rod 34. The other end of the pawl 92 selectively engages the teeth 88. The pawl is housed within a cavity formed in the base 24 and is biased outwardly away from the base by a spring (not shown). The pawl has an outer end engagement surface 94 that engages the cam 82 of the cam reel 76 for controlling the movement of the pawl between a first position in which it engages the teeth 88 and a second position in which it is disengaged therefrom. As illustrated in FIGS. 6A–6E, the cam 82 has a first portion **82*a* that positions the pawl 92 between two adjacent teeth 88 of the ratchet 84 for preventing the rotation of the spool 14 and a second portion 82*b* that moves the pawl 92 away from the teeth 88 for enabling the free rotation of the spool 14 about the center rod 34 thereby enabling the reeling off of yarn 12** from the spool.

Connecting the cam reel 76, power spring 48 and spring cup 54 to the braider stop 62 is a cable 100 which is fixedly connected to the cam reel 76 at one end thereof and to the braider stop 62 at its other end. More particularly, the cam reel 76 has an aperture 102 formed therein which is shaped to receive an enlarged bulbous end 104 (illustrated in broken lines in FIGS. 6A–6E) of the cable 100 for fixedly connecting the cable to the cam reel, and a groove 106 formed along the circumferential edge of the cam reel and into the aperture 102. The cable 100 extends through a sheave wheel 108 rotatably mounted on the base 24 of the frame 22 up to the point where it is suitably mounted on the braider stop 62. The arrangement is such that as tension on the yarn 12 increases, the braider stop 62 moves upwardly on the support rod 26 thereby rotating the cam reel 76 against the bias of the power spring 48, and upon reaching a predetermined tension, the cam reel 76 rotates so that the pawl 92 rides from the first portion **82*a* of the cam 82 to the second portion 82*b* thereof, thereby disengaging the pawl 92 from the teeth 88 for enabling yarn 12 to reel off the spool 14**.

Figure 6A:
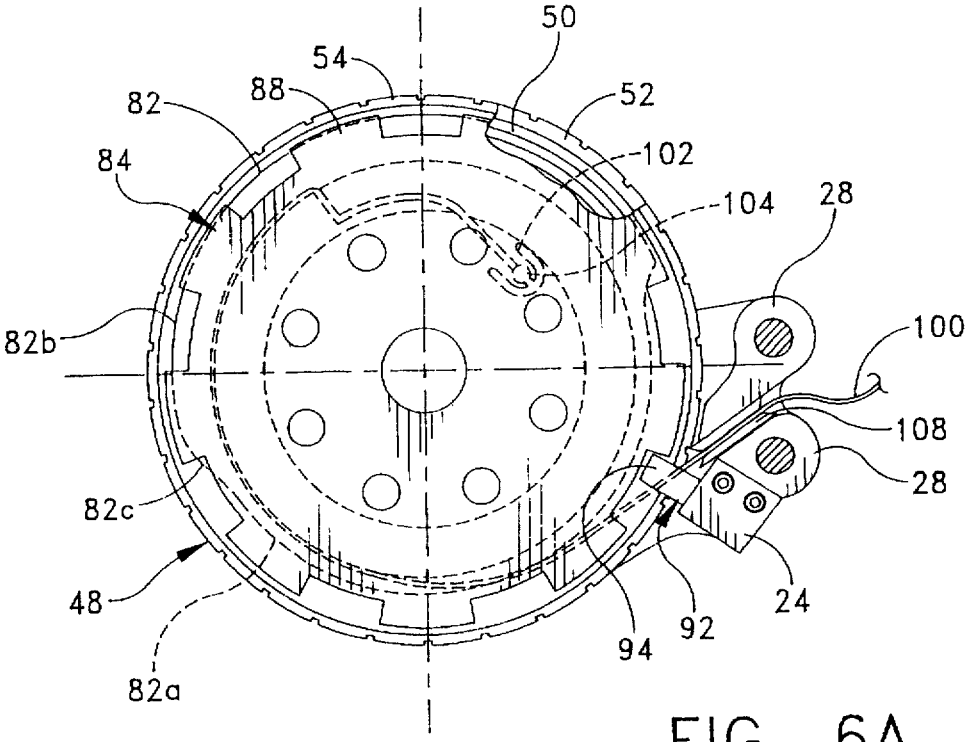
FIGS. 6A–6E are cross-sectional views taken along line 6—6 of FIG. 2, the views illustrating the spool carrier in sequential operating positions.
Figure 6B:
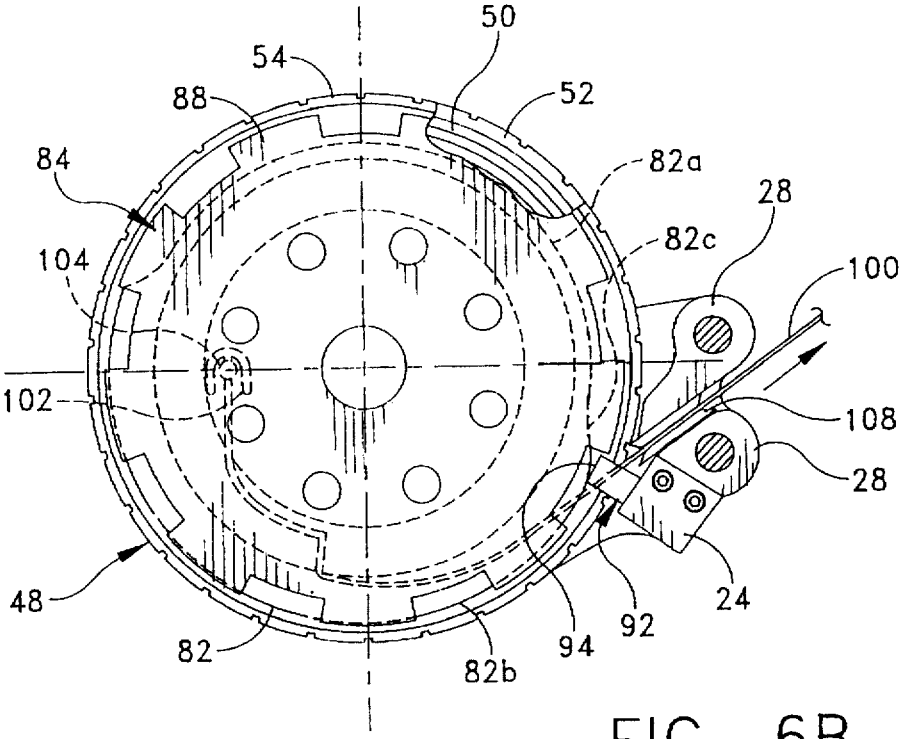

In operation, FIGS. 3 and 6A illustrate the spool carrier 10 in a position where the spool 14 is prevented from rotating. As shown, the pawl 92 is engaging the teeth 88 of the ratchet 84 thereby preventing the spool 14 from rotating. As tension in the yarn 12 increases, the braider stop 62 is raised which results in the cable 100 being pulled by the braider stop. This results in the cam reel 76 being rotated in a counterclockwise direction against the bias of the power spring 48. FIG. 6B illustrates the initial pull of the cable 100 on the power spring 48. It should be noted that the pawl 92 is still engaging the teeth 88 for preventing the free rotation of the spool 14.

Figure 6C:
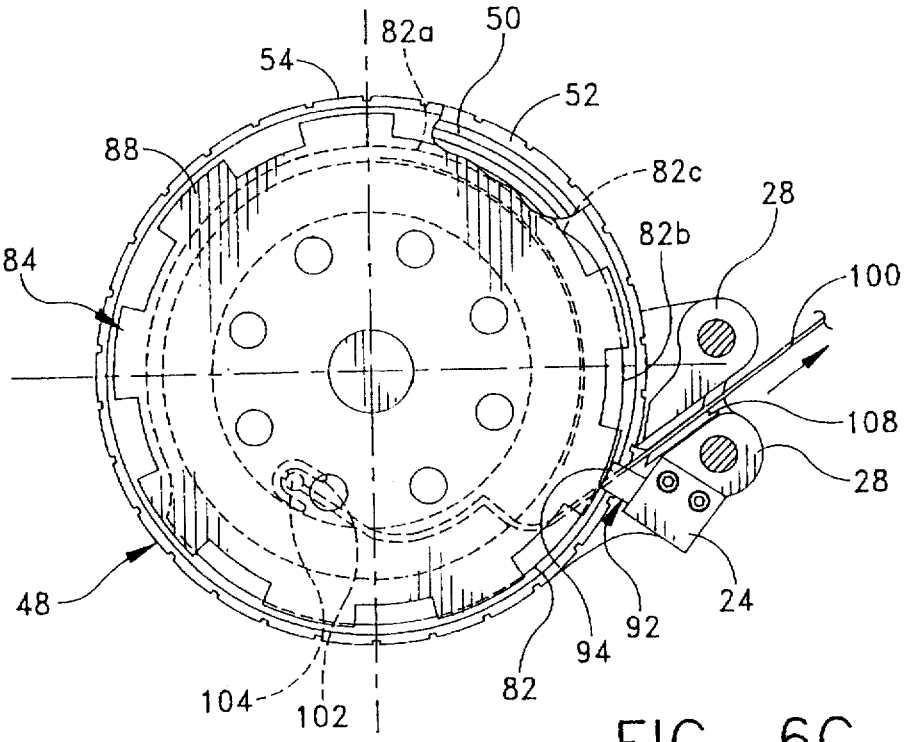
Figure 6D:
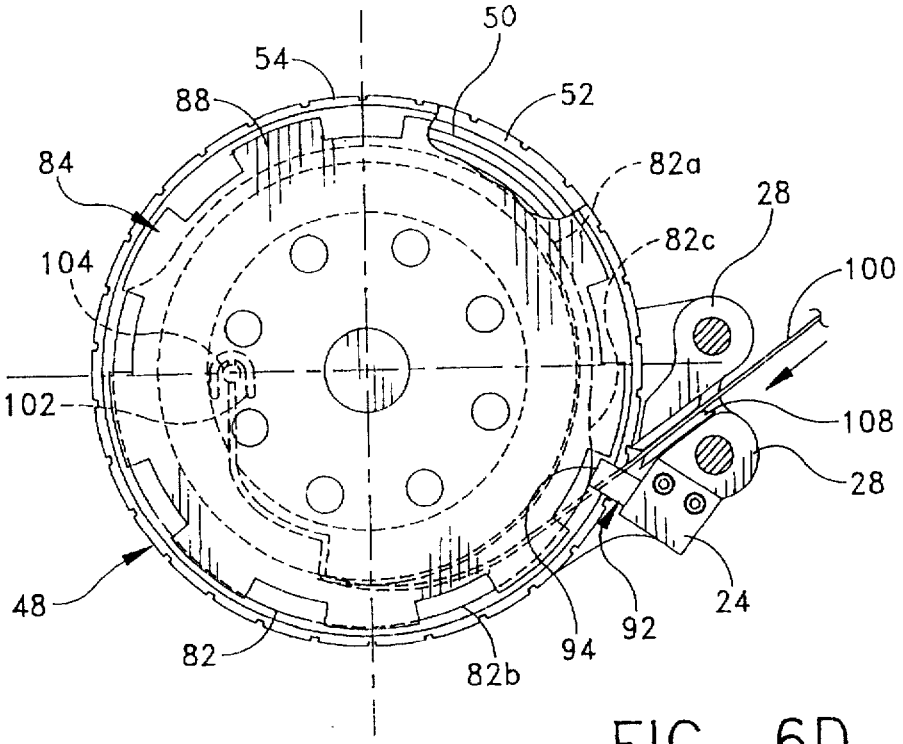

FIGS. 6C and 6D illustrate the cam reel 76 being rotated by the force of the cable 100 as the tension in the yarn 12 increases. Until the cam reel 76 rotates to the position illustrated in FIG. 6C, the pawl 92 rides on the first portion **82*a* of the cam 82. As shown in FIG. 6D, the cam reel 76 is rotated to a point where the pawl 92 engages the second portion 82*b* via a transition portion 82*c* of the cam 82. As shown, this second portion 82*b* extends radially outwardly on the cam reel 76 with respect to the first portion 82*a*, the first portion 82*a* generally maintaining a consistent arc with respect to the axis A about which the cam reel 76 rotates. As the second portion 82*b* moves radially outwardly, the pawl 92 moves away from the teeth 88**.

Figure 6E:
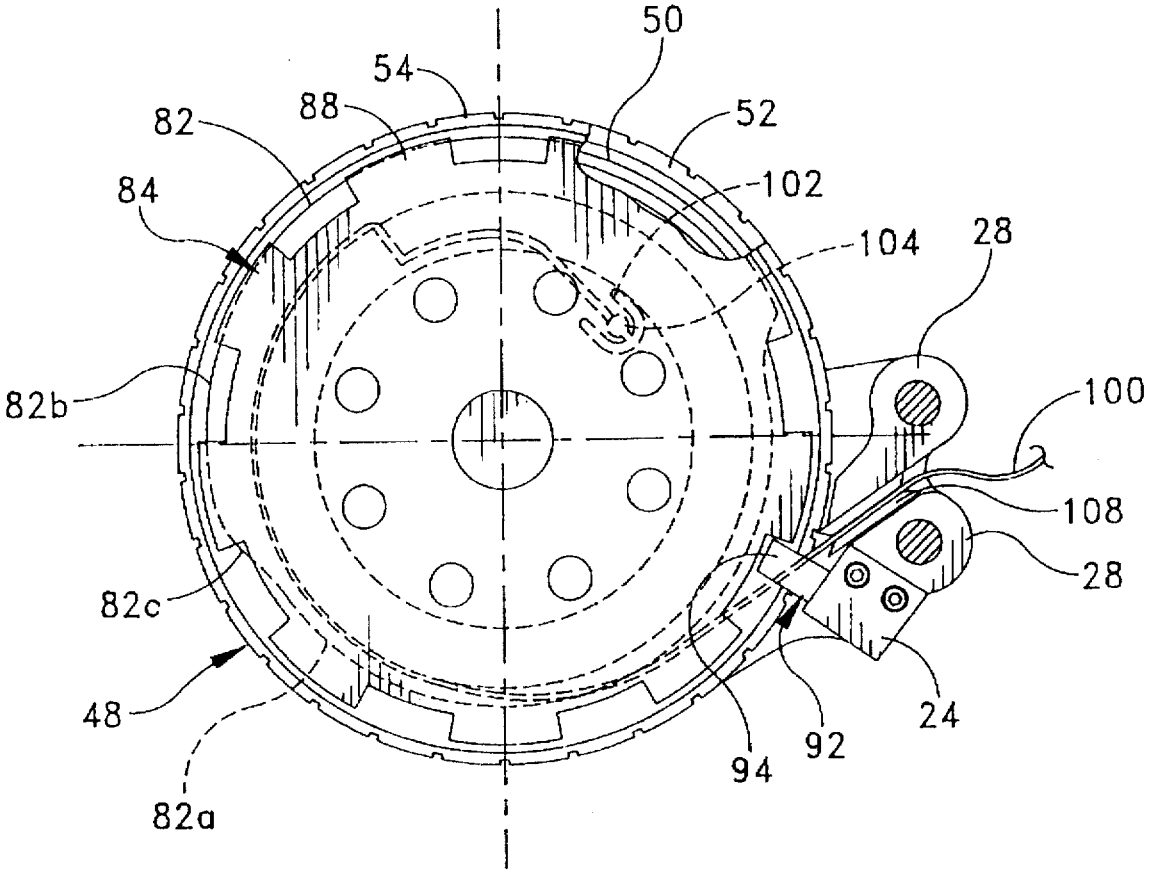

Turning now to FIGS. 4 and 6E, the tension in the yarn 12 pulls the braider stop 62 upwardly to a point where the cable 100 pulls the cam reel 76 in a position where the pawl 92 is at an end of the cam 82. As illustrated in FIG. 6E, the second portion **82*b* of the cam 82 positions the pawl 92 away from the teeth 88 so that it disengages the teeth for allowing the spool 14 to freely rotate. The free rotation of the spool 14 enables the braiding machine to draw yarn 12 off the spool. Once tension in the yarn 12 is reduced, the braider stop 62 is lowered by its own weight and by virtue of the resistance force applied on the cable 100 by the power spring 48. Since the power spring 48 biases the cam reel 76 in a clockwise direction, the cam reel is rotated clockwise when tension on the yarn 12 is reduced thereby moving the pawl 92 via the first portion 82*a* of the cam 82 to a point where the pawl 92 engages the teeth 88. This action locks the spool 14 in place and prevents it from freely rotating. The entire process repeats itself when tension in the yarn 12 increases to the point that the braider stop 62 is raised and the pawl 92 disengages the teeth 88**.

It should be observed that tension in the power spring 48 can be easily changed by rotating the spring cup 54 without having to disassemble the spool carrier 10. Also, the tension can be reset by merely pressing the push button 60 which releases the tension on the coil 50 of the power spring 48. This provides a significant improvement over the prior art spool carriers in which the spring must be removed therefrom by disassembling the carrier as witnessed in the patent to Harris in order to vary the tension of the spring. It should also be noted that the power spring 48 provides a more constant tension force than helical springs thus resulting in the spool carrier 10 operating in a more consistent manner.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A spool carrier for delivering yarn under tension from a spool to a braiding machine, the spool carrier comprising:

a frame having a base, a center rod mounted on the base in a position that it extends upwardly therefrom along a vertical axis, said center rod rotatably receiving the spool, and a support having means for retaining the spool axially in place; and tensioning means for providing tension on the yarn of the spool, said tensioning means being adapted to release yarn from the spool upon reaching a predetermined amount of tension on the yarn, said tensioning means comprising adjustable spring means mounted on said base for providing a resisting tension to the yarn, and yarn releasing means comprising engaging means, associated with the frame, for selectively engaging the spool, said engaging means being movable between a first position in which it engages the spool and prevents the spool from rotating, and a second position in which it is disengaged from the spool thereby allowing the spool to freely rotate, said yarn releasing means moving said engaging means to its second position when the tension on the yarn exceeds a predetermined tension of said spring means.

2. A spool carrier as set forth in claim 1, said adjustable spring means comprising a spring disposed within a spring cage, said spring and spring cage having openings formed therein for receiving the center rod of the frame therethrough.

3. A spool carrier as set forth in claim 2, said adjustable spring means further comprising a spring cup that receives the spring and spring cage therein, said spring cup engaging the spring cage for enabling rotation of the spring and spring cage when rotating the spring cup, wherein the spring force upon the spool as applied by the spring is adjusted upon rotating the spring cup.

4. A spool carrier as set forth in claim 2, the frame further having at least one support rod that interconnects the support and the base of the frame.

5. A spool carrier as set forth in claim 4, said yarn releasing means comprising a braider stop having a body portion that rides up and down on the support rod of the frame and an eye formed on the body portion for receiving yarn from the spool therethrough, said yarn, upon increasing tension thereon, being adapted to raise the braider stop, and upon decreasing tension thereon, being adapted to lower the braider stop.

6. A spool carrier as set forth in claim 5, said yarn releasing means further comprising a cam reel mounted on said spring, the cam reel being rotatable about the center rod with said spring cage and having a circumferential edge surface defining a cam, and a pawl which rides on the cam.

7. A spool carrier as set forth in claim 6, said pawl having one end mounted on the base, and an opposite end that is engagable with a ratchet that is engagable with the spool for rotation with the spool.

8. A spool carrier as set forth in claim 7, the cam having a first portion that positions the pawl between two teeth of the ratchet for preventing the rotation of the spool and a second portion that moves the pawl away from the teeth for enabling the free rotation of the spool.

9. A spool carrier as set forth in claim 8, said cam reel being attached to the braider stop by a cable, the arrangement being such that as tension on the yarn increases, the braider stop moves upwardly on the support rod thereby rotating the cam reel against the bias of the spring, upon reaching a predetermined tension, the cam reel rotates so that the pawl rides on the first portion of the cam to the second portion thereof thereby disengaging the pawl from the teeth of the ratchet for enabling yarn to reel off the spool.

10. A spool carrier as set forth in claim 9, said cam reel having a groove formed along the circumferential edge of the cam reel, said groove receiving the cable therein.

* * * * *